US005708944A

United States Patent [19]

Hyakutake et al.

[11] Patent Number: 5,708,944

[45] Date of Patent: Jan. 13, 1998

[54] IMAGE FORMING APPARATUS

[75] Inventors: Nobuo Hyakutake; Yuji Yokota; Yoshihiro Enomoto, all of Ebina, Japan

[73] Assignee: Fuji Xerox Co. Ltd., Tokyo, Japan

[21] Appl. No.: 716,480

[22] Filed: Sep. 19, 1996

[30] Foreign Application Priority Data

Sep. 20, 1995 [JP] Japan ..... 7-242137

[51] Int. Cl.[6] ..... G03G 15/01; G03G 15/16

[52] U.S. Cl. ..... 399/303; 399/66

[58] Field of Search ..... 399/303, 304, 399/308, 397, 398, 399, 66

[56] References Cited

FOREIGN PATENT DOCUMENTS

A-63-43177 2/1988 Japan .

A-5-27606 2/1993 Japan .

A-5-72915 3/1993 Japan .

*Primary Examiner*—Matthew S. Smith

*Attorney, Agent, or Firm*—Oliff & Berridge

[57] ABSTRACT

An image forming apparatus includes a control unit for forming an adsorb-charging region having a length along a paper transporting direction from a rear end of an image region on the recording paper adsorbed on the recording paper carrying/transporting member toward a backward direction by controlling operation-OFF timing of the adsorb-transferring charging means in such a manner that this operation-OFF timing is delayed from operation-OFF timing of the latent image forming unit, and this length of the adsorb-charging region becomes longer than, or equal to 1.5 mm.

5 Claims, 6 Drawing Sheets

IMAGE FORMING APPARATUS

BACKGROUND OF THE INVENTION

1. Field of the Invention

The present invention mainly relates to an image forming apparatus such as a color copying machine, and a color printer. More specifically, the present invention is directed to such a type of image forming apparatus that the following charging operations are carried out by one charging means, i.e., a recording paper is electrostatically adsorbed on a recording paper carrying/transporting member, and a toner image on the image carrying member is electrostatically transferred to the adsorbed recording paper.

2. Description of the Related Art

As such a type of image forming apparatus, the electronic photographic image forming apparatuses are known in, for example, Japanese Laid-open Patent application No.5-72915, No.5-27606, and No.63-43177 in which the adsorb-charging operation for adsorbing the recording paper to the recording paper carrying/transporting member, and the transfer-charging operation for transferring the toner image formed on the image carrier to the recording paper are performed by way of a single charger located at a transfer position of the image carrier inside the recording paper carrying/transporting member. In the first-mentioned type of image forming apparatus, when the toner image formed on the image carrier is transferred to the recording paper by the electronic photographic system, after the recording paper is once adsorbed on the recording paper carrying/transporting member formed in the drum-shaped structure, or the belt-shaped structure, and arranged near the transfer position of the image carrier, this adsorbed recording paper is transported to the transfer position for the transfer operation.

However, this sort of image forming apparatus owns various specific problems which never occur in other type of image forming apparatus for performing the above-described adsorb-charging operation and transfer-charging operation by the respective dedicated chargers (namely, adsorbing charger and transferring charger).

That is, when the recording paper after the transfer operation is exfoliated from the recording paper carrying/transporting member, the toner of the unfixed toner image transferred to the rear side of this recording paper is partially scattered. As a result, such a specific image defect that the toner image is disturbed will occur. The Applicants may predict that such an image defect is caused by the before-mentioned factors.

First of all, in such an image forming apparatus that the above-explained charge-removing charging operation and transfer charging operation are simultaneously carried out by a single charger, this single charger is controlled in such a manner that the single charger is basically operated by setting the transfer step as the reference. More precisely speaking, such a problem is produced if the charger is operated up to a time instant when this charger has passed the rear end of the recording paper, then this electrostatic history is formed on the image carrier (photosensitive member and the like) and thus the unnecessary image is formed. As a consequence, with respect to the operation-OFF timing of this charger, this charger is controlled in substantially synchronism with a time instant immediately after the toner-image formable region (image region) has been ended (normally, end timing of electrostatic latent image forming operation).

As a result, as shown in FIG.8*a*, since the blank region (paper rear end) 101*a* located backwardly from the rear end of the image region in the recording paper 101 on the paper carrying/transporting member 100 is not adsorb-charged by the charger, the recording paper is brought into such a condition that this recording paper is not sufficiently adsorbed with respect to the paper carrying/transporting member 100. Accordingly, when the recording paper 100 under such an adsorbing condition is supplied to the exfoliation stage by the exfoliating charger and the exfoliating (stripping) claw 102, the rear end 101*a* of this paper is floated from the surface of the carrying/transporting member to be separated, since the absorption attitude of this rear end can be no longer maintained over the paper carrying/transporting member 100 immediately before the exfoliation. Thus, a relative positional shift will occur in such a manner that the recording paper is deviated (slid) along the direction opposite to the transport direction A of the paper carrying/transporting member (such a deviation state as indicated by a dotted line of FIG. 8A). Then, as illustrated in FIG. 8B, it is conceiveable that the toner 103 on the recording paper is tensioned by the electrostatic force ( attracting force ) "F" produced between the electron charges of this toner 103 and the electron charges corresponding thereto on the paper carrying/transporting member 100 during the rotating transportation due to the relative positional shift between the rear end of this recording paper and the paper carrying/transporting member, so that this toner 103 is moved over the paper 101 while being scattered.

Also, in such a case that the above-described charge-removing charging operation and transfer-charging operation are simultaneously performed by one charger, generally speaking, the operation-OFF timing of this charger is set to be executed immediately after the operation-OFF timing of the latent image forming means such as the exposing apparatus for forming the electrostatic latent image. Each of the operation-OFF timing of this single charger and the latent image forming is set as follows, depending on the sort of recording paper under use. In other words, when a recording paper having a fixed size supplied from the paper supply tray is used, the operation-OFF timing of the latent image forming means is controlled on the basis of the reference signal (namely, signal produced in conjunction with rotation of paper carrying/transporting member) used to control the image forming process (TRO signal), whereas the operation-OFF timing of the single charger is controlled on the basis of the signal (register-OFF signal) produced by the paper supply registering means (register roller) for the fixed size paper which senses that the rear end of the paper has passed, and which is located in the paper transportation path, so as to supply the recording paper to the paper carrying/transporting member at preselected timing. When the recording paper having the non-fixed size supplied from the hand delivery tray is used, the operation-OFF timing of the latent image forming means is controlled based on the register-OFF signal, whereas the operation-OFF timing of the charger is controlled on the basis of the signal (pre-register-OFF signal) produced by the paper supply registering means (pre-register roller) for the non-fixed size which senses that the rear end of the paper has passed, and which is located in front of the transportation path of the paper supply registering means for the fixed size.

As described above, since the register-OFF signal and the pre-register-OFF signal own the lower sensing precision and in addition, the operation-OFF timing of the latent image forming means and also the charging means is to employ the different signals from each other as the reference signals, there are some cases that the operation-OFF timing of the charging means is slightly shifted with respect to the operation-OFF timing of the latent image forming means. It is predictable that this timing shift could further cause the image defects due to the above-explained toner scattering phenomenon. In the worst case, since the sensing precision of the register-OFF signal and the pre-register-OFF signal is low, it is moreover predictable that the above-described electrostatic history forming problem to the image carrier may occur.

SUMMARY OF THE INVENTION

The present invention has been made to solve the above problems with the conventional apparatus, and therefore an object of the present invention is to provide an image forming apparatus in which both an adsorb-charging operation for adsorbing a recording paper on a recording paper carrying/transporting member and a transfer-charging operation for transferring a toner image formed on an image carrier to the recording paper are carried out by way of the same charging means, which is capable of preventing an image defect in which when the recording paper is exfoliated from the paper carrying/transporting member, toner of an unfixed toner image is scattered which has been transferred to a rear end side of this recording paper.

To achieve the above-described object, according to the present invention, there is provided an image forming apparatus comprising:

- latent image forming means for forming an electrostatic latent image;
- an image carrier on which a toner image is formed by developing the latent image formed by said latent image forming means;
- a recording paper carrying/transporting member arranged adjacent to a transfer position of this image carrier, for transporting a recording paper to which the toner image on the image carrier is transferred, while adsorbing said recording paper;
- one adsorb-transferring charging means for performing an adsorb-charging operation for causing the recording paper to be adsorbed on said recording paper carrying/transporting member and a transfer-charging operation for transferring the toner image on the recording paper;
- control means for controlling operation-OFF timing of said adsorb-transferring charging means so that the operation-OFF timing is delayed from operation-OFF timing of said latent image forming means to form an adsorb-charging region having a predetermined length along the paper transporting direction from a rear end of an image region on the recording paper adsorbed on said recording paper carrying/transporting member backwardly.

It should be noted that this predetermined length is preferably selected to be 1.5 mm or longer.

In the above-described mechanical means, the operation-OFF timing of the adsorb-transferring charging means is so controlled/set in such a manner that when the image is continuously formed, this operation-OFF timing does not exceed the rear end of the recording paper (namely, adsorb-charging region is not formed while exceeding rear end of paper) in order to prevent the electrostatic history formation to the image carrier. Alternatively, in the final image forming cycle, this operation-OFF timing may be controlled/set in such a manner that this operation-OFF timing exceeds the rear end of the recording paper. In this case, although the electrostatic history would be formed on the image carrier, the charges on the surface of the image carrier after the image transfer are removed, and this surface is set to the waiting condition for the next image forming cycle. Therefore, no unnecessary image is formed.

In the technical means, the control means preferably executes the controls of the operation-OFF timing for the latent image forming means are the adsorb-transferring charging means by using the signal periodically generated in response to the rotations of the recording paper carrying/transporting member as the reference signal.

Also, in the above described technical means, the control means preferably performs the operation-OFF timing controls of the latent image forming means and the adsorb-transferring charging means when such a recording paper having a non-fixed size is used whose length along the paper transporting direction. That is, the recording paper carrying/transporting member is rotated by 1 cycle only so as to adsorb the recording paper, and further the length of the recording paper having the non-fixed size along the transporting direction is sensed by the paper size sensing means located in the recording paper transporting path before the paper absorption. Then, the above-described operation-OFF timing is controlled by utilizing this sensing signal. In this case, each of the above-explained operation-OFF timing may be preferably and finally controlled in response to the above-mentioned reference signal by determining application signal timing of the above reference signal based upon the sensing signal from the paper size sensing means. In the case that the image is continuously formed by using the above-explained non-fixed size recording paper, since both the paper size sensing operation and the 1-cycle rotation for adsorbing the paper on the recording paper carrying/transporting member are no longer required in the control operation by the control means after the second recording paper, the control operation may be performed in a similar manner for the control operation of the fixed-size recording paper.

Moreover, in the above-explained technical means, when the images are formed on both surfaces of the recording paper, the control means preferably executes the control operation in such a manner that a length of an adsorb-charging region along the paper transporting direction when the image is formed on the second surface is made longer than a length of an adsorb-charging region along the paper transporting direction when the image is formed on the first surface.

On the other hand, in the above-described technical means, as the recording paper carrying/transporting member, the following members may be employed. That is, in addition to a derivative film or a derivative sheet such as polyethylene terephthalate and polyvinylidene fluoride being wound on a drum frame, this derivative film or sheet is tensioned on a plurality of rolls and rotated in a belt form.

Also, in the above-described technical means, as the adsorb-transferring charging means, any sorts of charging means may be employed which own such charging capabilities of both the electrostatic absorption of the recording paper to the recording paper carrying/transporting member and the electrostatic transfer operation of the toner image to the recording paper. For instance, contact type chargers such as roll-shaped chargers, brush-shaped chargers, and blade-shaped may be employed in addition to such a non-contact type charger as a corotron charger.

The above and other objects and features of the present invention will be more apparent from the following description taken in conjunction with the accompanying drawings.

DETAILED DESCRIPTION OF THE PREFERRED EMBODIMENTS

Now, a description will be given in more detail of the preferred embodiment of the present invention with reference to the accompanying drawings.

Figure 1:
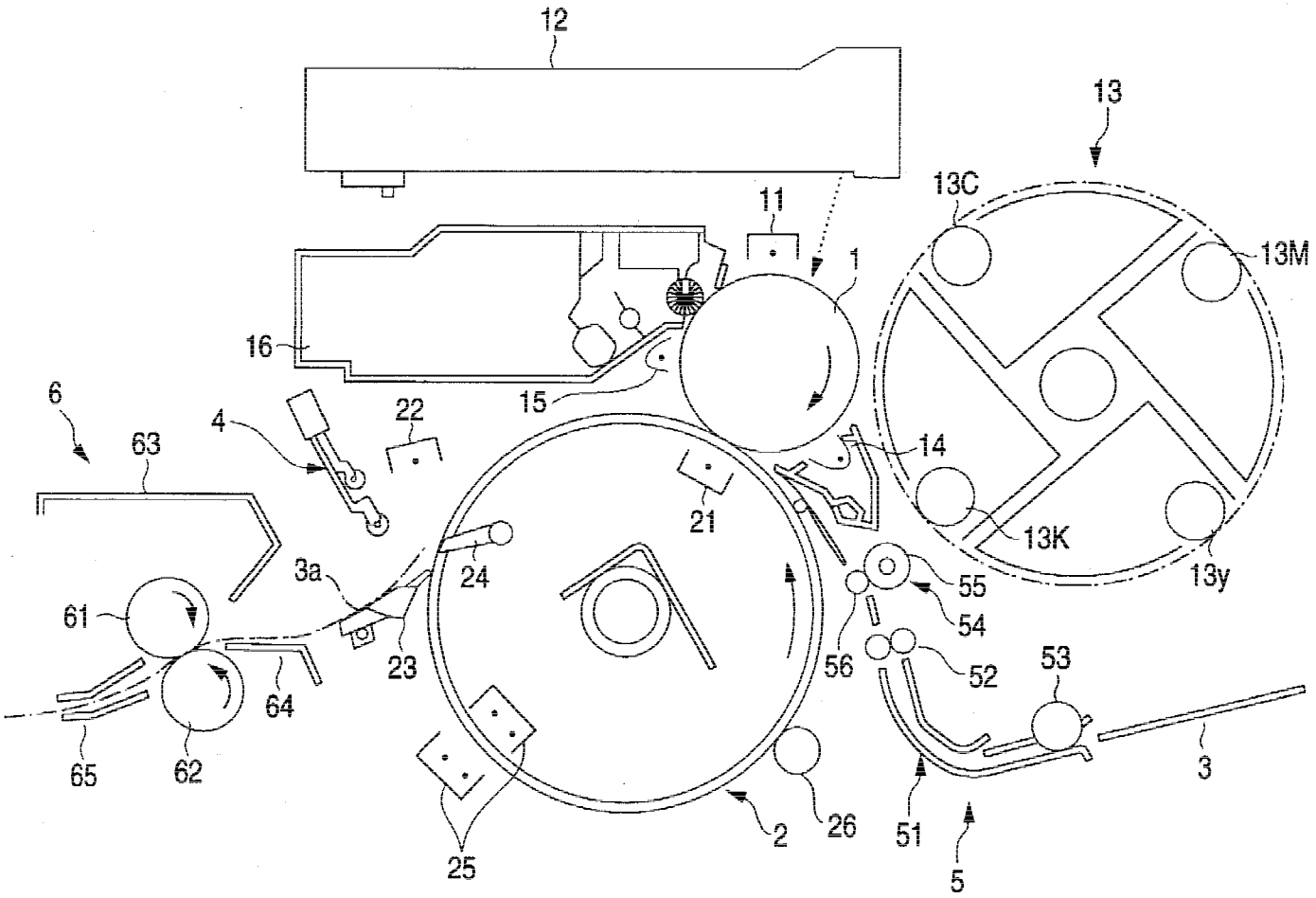
FIG. 1 is a conceptional diagram for showing a major portion of an image forming apparatus according to an embodiment of the present invention.

FIG. 1 indicates an image forming apparatus according to an embodiment mode of the present invention. In this drawing, reference numeral 1 indicates a photosensitive drum functioning as an image carrier rotated along an arrow direction, reference numeral 2 represents a transfer drum functioning as a recording paper carrying/transporting means rotated along the arrow direction, reference numeral 21 shows an adsorbing/transferring control functioning as an adsorb-transferring charging means, reference numeral 3 denotes a recording paper, reference numeral 5 is a transportation system for paper supply side, and reference numeral 6 shows a fixing apparatus.

In this image forming apparatus, a charger 11 for charging a surface of the photosensitive drum 1 in a uniform manner, a laser type image exposing apparatus (ROS) 12 functioning a latent image forming means for forming an electrostatic latent image on the charged surface of the photosensitive drum 1, a rotary type developing apparatus 13, a transfer precharger 14, a cleaning pre-charge-remover 15, and a cleaning apparatus 16 are arranged around this photosensitive drum 1 in this order. The rotary type developing apparatus 13 is equipped with four developers 13K, 13Y, 13M, 13C, which store black (K) toner, yellow (Y) toner, magenta (M) toner, cyan (C) toner, respectively. During the developing operation, a preselected developer for storing the toner corresponding to the color of the electrostatic latent image is rotated to a position near/opposite to the photosensitive drum 1.

This transfer drum 2 is constructed by that a transfer film is wound on a ring-shaped drum frame. Around this transfer drum 2, the following devices are arranged in this order, i.e., an exfoliating charge removing device 22 for removing charges on the surface of the recording paper 3 after the transfer stage; an exfoliating claw 23 for mechanically exfoliating the recording paper 3 from which the surface charges have been removed from the transfer drum (transfer film) 2; an inner depressing member 24 for pushing up the transfer film from the inside of the transfer drum to deform this transfer film in conjunction with the exfoliating operation of this exfoliating claw 23; one pair of charge removing devices 25 for charge-removing the transfer film (transfer film) 2 after the recording paper 3 is exfoliated; and a cleaning roll 26 for removing paper dust and the like attached to the transfer drum 2. Also, a position reading sensor 27 is arranged at the transfer drum 2, which senses that markers formed every a half of circumference of this drum frame (½ cycle) pass through this sensor.

Furthermore, a major portion of this transportation system 5 for paper supply side is constituted by a transport guide member 51, a register roller 52, and a pre-register roller 53. The transport guide member 51 is to supply the recording paper 3 to an adsorb-transfer position which is located adjacent/opposite to the photosensitive drum 1 and the transfer drum 2. The register roller 52 starts to transport a recording paper 3 having a fixed size to the adsorb-transfer position at predetermined timing. The pre-register roller 53 starts to transport another recording paper 3 having a non-fixed size to the adsorb-transfer position at preselected timing. Then, the recording paper 3 having the fixed size is stored into a paper supply tray (not shown), and is transported to the register roller 52 during use. On the other hand, the recording paper 3 having the non-fixed size is set to a hand-delivery tray (not shown either), and is transported to the pre-register roller 53 during use.

Figure 2:
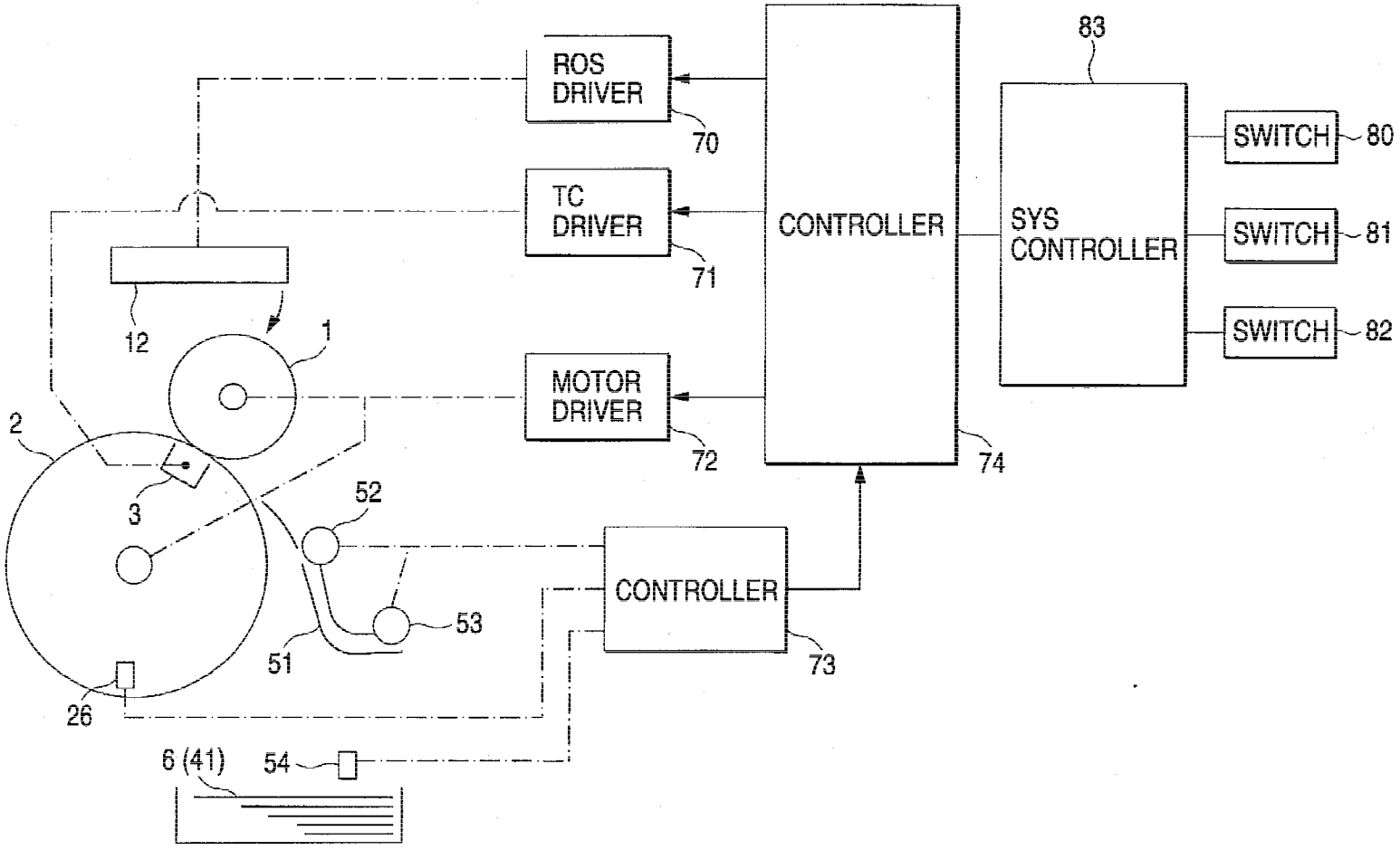
FIG. 2 is a block diagram for showing a control system for forming the adsorb-charging region of the image forming apparatus.

Moreover, this image forming apparatus is comprised of a control means as illustrated in FIG. 2. In this drawing, reference numeral 70 shows an ROS driver for driving the laser type image exposing apparatus(ROS) 12, reference numeral 71 denotes a TC driver for driving the adsorbing/transferring corotron(TC) 21, reference numeral 72 denotes a motor driver for rotating the photosensitive drum 1 in synchronism with the rotations of the transfer drum 2, and reference numeral 74 represents a controller for controlling the ROS driver 70, the TC driver 71, and the motor driver 72 in accordance with a predetermined sequence.

Also, reference numeral 73 denotes a reference signal detecting circuit for inputting thereto the sensing signal issued from the position reading sensor 27 arranged at the transfer drum 2, the sensing signals produced by sensing that the rear end of the paper has passed from the register roller 52 and the pre-register roller 53, and a size sensing device 57 for sensing the size of the fixed-size recording paper 3 stored in the paper supply tray to thereby set a reference timing signal(TRO) for control operation. Also this reference signal detecting circuit 73 inputs this reference timing signal TRO to the controller 74.

Furthermore, reference numeral 80 indicates a start switch for starting the image forming process operation, reference numeral 81 denotes a paper supply mode selection switch for selecting a hand delivery of the recording paper 3, and reference numeral 82 represents an image forming mode selection switch for selecting an image forming mode (color mode, monochromatic mode, and double-surface print mode). Further, reference numeral 83 shows an SYS controller for requesting the controller 74 to execute a predetermined control sequence (in this example, control sequences exclusively directed to fixed-size print, non-fixed size print, hand delivery of paper, and double-surface print) in response to the above-described respective switch inputs.

Then, the image forming operation is carried out by this image forming apparatus as follow:

The following description is made of such a case that, for instance, a full color image is formed on a recording paper having a fixed size. First, after the photosensitive drum 1 is charged by the charger 11, the image is exposed on this charged surface of the photosensitive drum 1 by the laser type image exposing apparatus 12, so that a first colored electrostatic latent image is formed. Then, this electrostatic latent image is developed by the developer 13 for storing toner in the corresponding color to become a toner image. After this first colored toner image is charge-processed by the transfer precharger 14, the precharge-processed toner image is transported to the transfer position.

On the other hand, after the recording paper 3 having the fixed size is supplied from a predetermined tray to the register roller 52, this recording paper 3 is fed out toward the position (adsorb-transfer position) located adjacent/opposite to the photosensitive drum 1 and the transfer drum 2 by driving the register roller 52 at predetermined timing. Then, a tip portion of the recording paper 3 reaches and then has passed this adsorb-transfer position. At a time instant when the toner image reaches the adsorb-transfer position, the adsorb-transfer corotron 21 starts its operation. As a reshlt, when the recording paper 3 is electrostatically adsorbed onto the transfer drum 2, at the same time, the first colored toner image is electrostatically transferred to the recording paper.

Subsequently, a second colored toner image, a third colored toner image, and a fourth colored toner image are sequentially formed on the photosensitive drum 1 by similarly repeating this first colored toner image forming step and the transfer step thereof. Furthermore, these second to fourth colored toner images are sequentially adsorbed on the transfer drum 2, so that these colored toner images are successively transferred to the recording paper 3 to which the first colored toner image has been transferred.

When this final colored (fourth colored) toner image has been transferred, after the charges of the recording paper 3 is removed by the exfoliating/charge remover 22 this recording paper 3 is exfoliated from the surface of the transfer drum 2 by way of the mechanical exfoliation by the exfoliating claw 23 and by deforming the transfer film of the transfer drum 2 by the inner depression member 24. Then, this exfoliated recording paper 3 is sent to the fixing apparatus 6, and passes through nip portions of a heating roller 61 and a pressure applying roller 62, so that the transferred unfixed toner image is fixed. On the other hand, after the charges on the transfer drum 2 are removed by one pair of charge removing devices 25, from which the recording paper has been exfoliated, the paper dust and the like attached on the transfer drum is removed by the cleaning apparatus 26.

Next, this image forming apparatus is operated in the below-mentioned control manner by the above-explained control means (FIG. 2).

Figure 3:
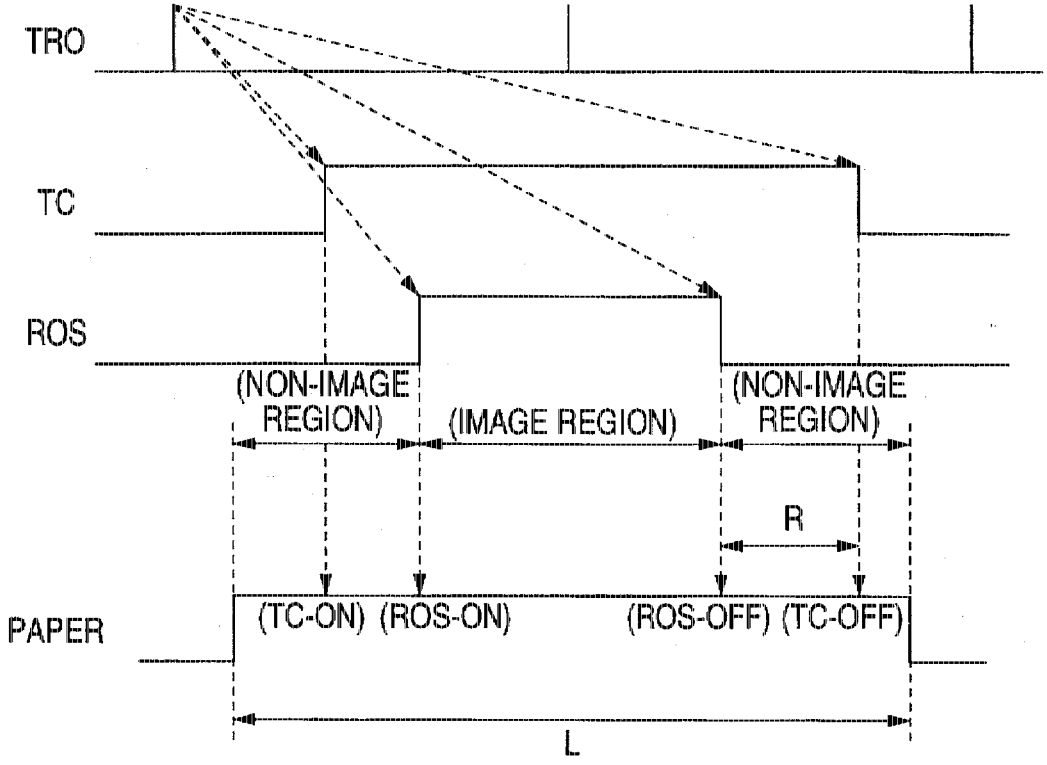
FIG. 3 is a relative relationship for representing control sequences when the adsorb-charging region is formed (on the recording paper having the fixed size), namely, represents the mutual relationship of the respective ON/OFF timing of the image exposing apparatus and the adsorb-transfer corotron, and the reference signals, in connection with the positions on the recording paper.

FIG. 3 is a diagram for representing a relationship among the reference signal TRO for control purposes, and each ON/OFF timing of the operations of the laser type image exposing apparatus(ROS) 12, and also of the adsorb-transfer corotron(TC) 21 in connection with the positions on the recording paper 3.

That is, since the start switch 80 is turned ON, the photosensitive drum 1 is commenced to be rotated in synchronism with the transfer drum 2, and the position reading sensor 27 reads out the marker which passes through this sensor 27 two times per 1 rotation (1 cycle) of the transfer drum 2, and then sends this sense signal to the reference signal detecting circuit 73. Then, the signal acquired by the position read sensor 27 is basically used as the reference timing signal TRO during the control operation, and is supplied to the controller 74. In the case that the recording paper 3 having the fixed size is used, the information about this paper size is inputted from the size sensing device 57 via the reference signal detecting circuit 73 to the controller 74.

Then, both an ROS-ON signal and a TC-ON signal, which have been set based upon this reference signal TRO after a predetermined time, are sent from the controller 74 to the ROS driver 70 and the TC driver 71, so that the operations of the laser type image exposing apparatus 12 and of the adsorb-transfer corotron 21 are commenced in response to the times of the respective ON signals. Next, both an ROS-OFF signal and a TC-OFF signal, which have been set based upon this reference signal TRO in connection with the paper size detection signal after a predetermined time, are sent from the controller 74 to the ROS driver 70 and the TC driver 71, so that the operations of the laser type image exposing apparatus 12 and of the adsorb-transfer corotron 21 are stopped in response to the setting times of the respective ON signals.

As a result, an electrostatic latent image, i.e., a toner image having a preselected region width with respect to a length "L" of the recording paper 3 along the transportation direction is formed on the photosensitive drum 1. On the other hand, at a time instant when the tip portion of the recording paper has slightly passed through the transfer position of the transfer drum 2, the charging operation by the adsorb-transfer corotron 21 is carried out for the recording paper 3. Thus, the recording paper 3 is adsorbed onto the transfer drum 2, and the above-described toner image is transferred to the adsorbed recording paper 3.

Figure 4:
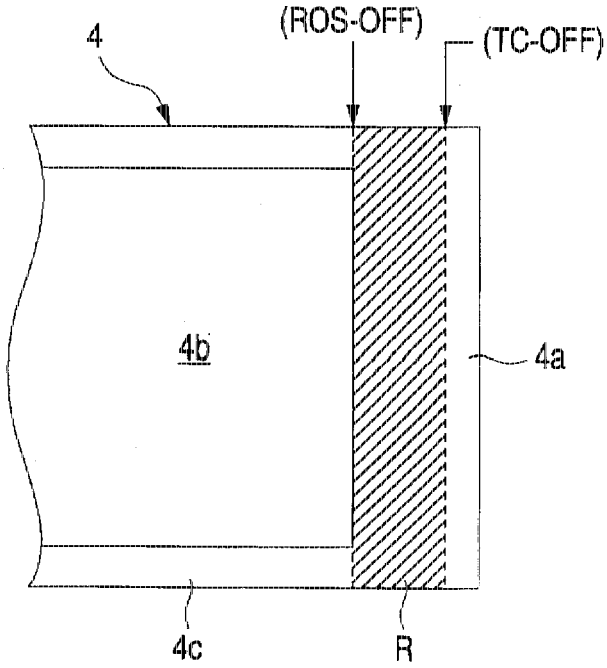
FIG. 4 is a plan view for explaining the adsorb-charging region formed on the rear end side of the recording paper.

At this time, the adsorb-transfer corotron 21 is controlled in such a manner that this corotron 21 is operated for a time being after the operation of the laser type image exposing apparatus 12 is complete (ROS-OFF), and thereafter the adsorb-transfer operation thereof is ended (TC-OFF). As a result, as represented in FIG. 3 and FIG. 4, the charging operation is performed backwardly from a rear end of an image region 3*b* only by a difference between the ROS-OFF timing and the TC-OFF timing in a rear end portion 3*a* of the recording paper 3 in order to perform the adsorbing operation by the adsorb transfer corotron 21. Accordingly, an adsorb-charging region R is formed. Then, since this adsorb-charging region R is formed, the rear end portion of the recording paper 3 is sufficiently adsorbed with respect to the transfer drum 2. Therefore, as this absorption condition is continuously held even during the exfoliating operation, it is possible to suppress the positional shift such as "slide" easily occurred between this recording paper and the transfer drum 2. As a result, it is possible to prevent an occurrence of such an image defect caused by the toner scattering phenomenon at the rear edge portion of the recording paper during the exfoliating operation.

Figure 5:
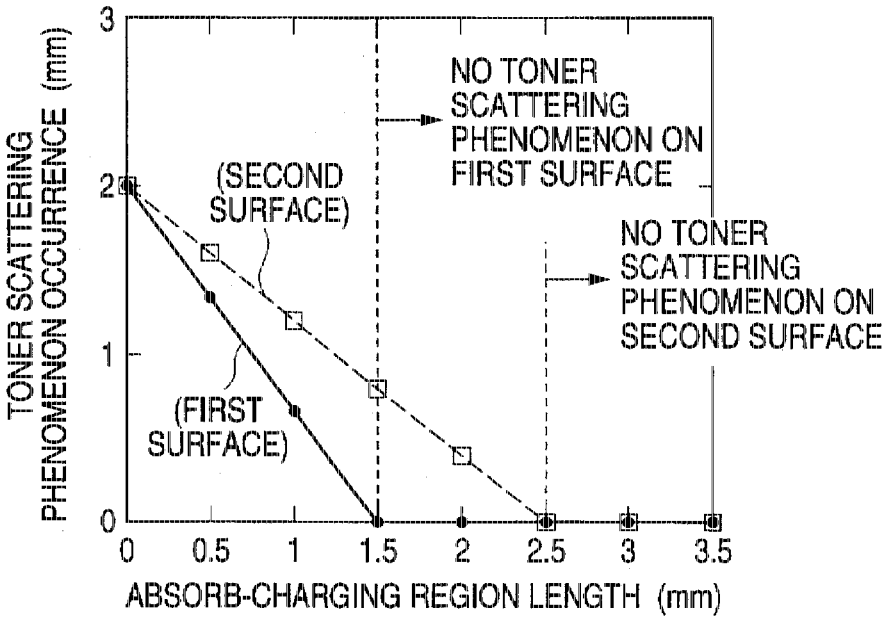
FIG. 5 is a graphic representation for showing the relationship between the length of the adsorb-charging region along the paper transportation direction and the toner scattering phenomenon occurring condition based on the measurement data.

In this case, the following investigation about toner scattering occurrence conditions when the recording paper is exfoliated in such a case that the above-described ROS-OFF timing and TC-OFF timing are set/changed to adjust the length of the adsorb-charging region R along the paper transportation direction. The toner-scattering occurrence results are indicated in FIG. 5 (refer to results indicated by a solid line). An ordinate of this drawing represents positions where the toner scattering phenomenon occurs, separated from the end portion of the image region.

As apparent from FIG. 5, while the length of the adsorb-charging region R along the paper transportation direction is made longer, the toner scattering occurrence position is moved in such a manner that this position is approximated to the rear end of the image region, and if this length becomes longer than a predetermined value, then the toner scattering phenomenon does not occur. Thus, according to the present invention, the control operation is carried out by properly setting the above-described ROS-OFF timing and TC-OFF timing in such a manner that the adsorb-charging region R is formed whose length along the paper transportation direction (as a distance on the recording paper) becomes greater than at least 1.5 mm from the rear end of the image region 3*b* toward the rear side in the rear end portion 3*a* of the recording paper adsorbed on the transfer drum. Then, the TC-OFF timing is controlled/set in such a manner that when the same image is continuously formed, this image must not exceed the rear end 3*a* of the recording paper. Alternatively, when the transfer step of the final colored toner image is accomplished (when the next image is not continuously formed), this toner image may exceed the rear end 3*a* of the recording paper. Even when it is so set that the toner image exceeds the rear end of the paper, there is no problem, because the electrostatic history formed on the photosensitive drum is erased by the charge removing operation by the charge removing device 15 and the charging operation by the charging device 11 due to no presence of a subsequent image. That is, this electrostatic history does not appear when the next image is formed.

Next, a description will now be made of contents of control operations when an image is formed by using a recording paper having a non-fixed size, as the recording paper 3, whose length along the paper transportation direction is unknown.

When the recording paper 3 having the non-fixed size is utilized, the length thereof along the paper transportation direction is not known at a time instant when the image forming cycle is commenced, which is different the recording paper having the fixed size. Thus, under such a condition, the operation-ON timing and the operation-OFF timing of the image exposing apparatus 12 and the adsorb-transfer corotron 21 cannot be determined based on the reference signal TRO. First, the length of this paper along the paper transportation direction is defined. Normally, since the non-fixed size recording paper 3 is supplied from the hand delivery tray as in this image forming apparatus, when this information is inputted from the paper supply mode selection switch 81 to the SYS controller 83, this SYS controller 83 requests the controller 74 to execute a control sequence in case of the non-fixed size recording paper.

In this image forming apparatus, the length of the non-fixed size recording paper along the paper transportation direction is defined by utilizing the pre-register roller 53 of the paper supply-sided transportation system 5 as the paper size sensing means. In other words, when the non-fixed size recording paper is supplied/transported, the time period during which the rear end of this paper has passed through the pre-register roller 53 is sensed, and this sensing signal is inputted into a reference signals detecting circuit 73, so that the length of this non-fixed size recording paper is defined. However, in such a type of image forming apparatus that both the adsorb-charging operation and the transfer-charging operation are performed by a single charger 21, since a distance from the pre-register roller 53 to the adsorbing position of the transfer drum 2 is short, such a case happens to occur. That is, a tip portion of a non-fixed size recording paper reaches the adsorbing position of the transfer drum unless a rear end of this non-fixed size recording paper has passed through the pre-register roller 53, depending upon sorts of recording papers.

Figure 6:
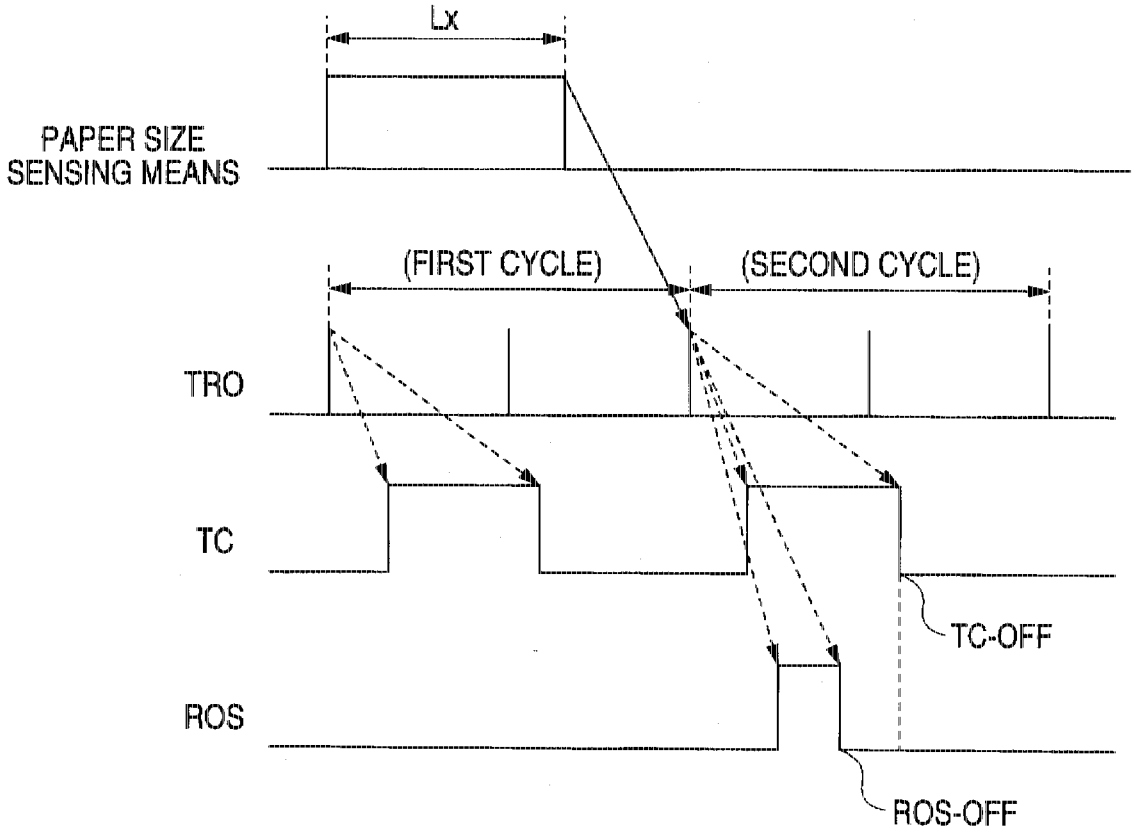
FIG. 6 is a relative relationship diagram for indicating a control sequence when a recording paper having a non-fixed size is used.

To firmly define the length of this non-fixed size paper and firmly adsorb this paper, as illustrated in FIG. 6, the transfer drum 2 is controlled in order that this transfer drum 2 is rotated by 1 cycle only for the absorption step (without transfer operation). Concretely speaking, a control signal for rotating the transfer drum 2 by 1 rotation is transferred from the controller 74 to the motor drive 72, and also only the adsorb-transfer corotron 21 is activated, so that such a control signal for not operating the image exposing apparatus 12 is sent to the ROS driver 70 and the TC driver 71, respectively. At this time, the controller 74 produces a TC-OFF signal in order that the adsorb-charging operation by the corotron 21 is not made over the rear end of the recording paper.

As described above, when the recording paper 3 having the non-fixed size is used, the transfer drum 2 is rotated by 1 rotation only in the first cycle for the absorption operation, during which a length "Lx" of this recording paper along the paper transportation direction is defined, and furthermore, this recording paper is firmly adsorbed on the transfer drum 2. Then, at such a stage that the paper length "Lx" is defined and then the control reference point of the reference signal TRO is determined, the operation-ON timing and the operation-OFF timing of the image exposing apparatus 12 and the adsorb-transfer corotron 21 are determined based upon this reference signal TRO in accordance with the paper length Lx. Then, similar to such a case that the paper length is known, the operation-OFF timing of the image exposing apparatus 12 and the adsorb-transfer corotron 21 is controlled. As a consequence, a predetermined adsorb-charging region "R" can also be formed on the rear end portion of the non-fixed size recording paper.

Next, a description will now be made of control contents when images are formed on both surfaces of the recording paper 3.

The Inventors could find out such a fact that the relationship between the length of the adsorb-charging region R along the paper transportation direction and the condition of the toner scattering occurrence is different in the first surface case (involving when image is formed only on a single surface) and in the second surface case. This result is also indicated in FIG. 5 (namely, the result denoted by a dotted line corresponds to the second surface case). That is to say, even when the adsorb-charging region R is formed during the image forming process of the second-surface in such a manner that the length thereof along the paper transportation direction is made longer than, or equal to 1.5 mm similar to the first surface, it could be found out that the toner scattering phenomenon occurs. This may be caused by the below-mentioned factors. That is, since the recording paper 3 for forming the image on the second surface has been processed in the fixing step, this recording paper 3 is set under low humidity condition, and the recording paper (especially, front/rear end portions of this paper) is set under curl condition. Accordingly, the adsorbing force of the rear end portion of this recording paper with respect to the transfer drum 2 is lowered, as compared with that produced when the image is formed on the first surface.

As a consequence, in accordance with the present invention, such a control operation is performed that the length of the adsorb-charging region along the paper transportation direction when the image is formed on the second surface is made longer than that when the image is formed on the first surface. Preferably, the length of the adsorb-charging region along the paper transportation direction when the image is formed on the second surface is selected to be longer than, or equal to at least 2.5 mm (as a distance on the paper).

Figure 7A:
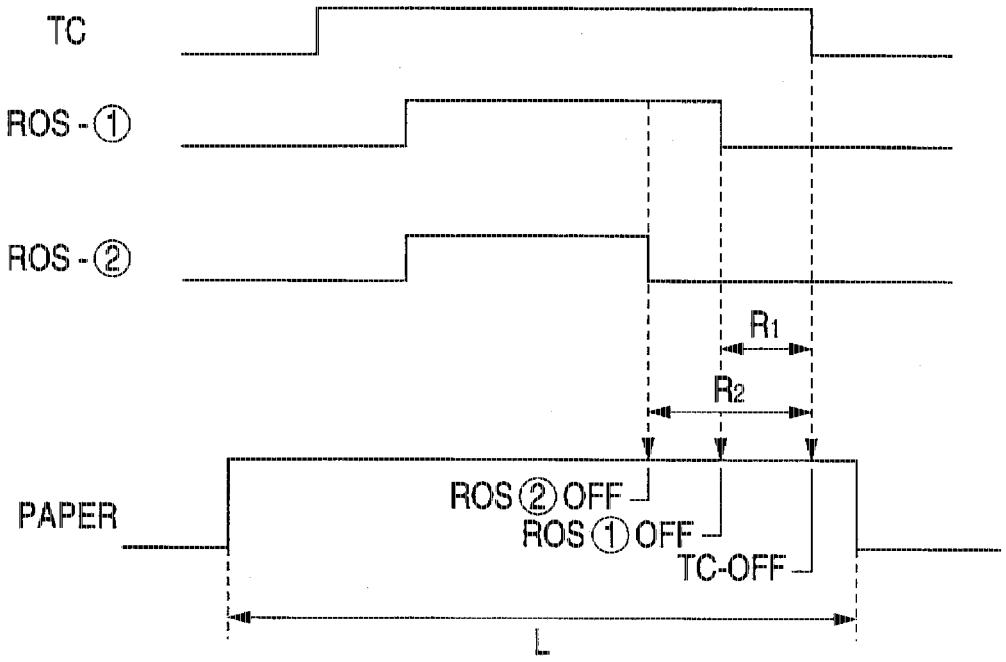
FIGS. 7A and 7B are relative relationship diagrams for indicating a control sequence when images are formed on both surfaces of a recording paper.

As represented in FIG. 7A, in this image forming apparatus, the control operation is set based upon the reference signal TRO in such a manner that the operation-OFF timing (ROS2-OFF) of the image exposing apparatus 12 during the second surface image forming operation is shortened, as compared with the operation-OFF timing (ROS1-OFF) of this image exposing apparatus 12 during the first surface image forming operation. Accordingly, a length of an adsorb-charging region R2 of the second surface is made longer than that of an adsorb-charging region R1 of the first surface. In other words, the operation-OFF timing of the image exposing apparatus 12 is varied between the first surface and the second surface, so that the length of the adsorb-charging region during the second surface image forming operation is adjusted.

Concretely speaking, when an instruction of the double-surface print mode is inputted from the image forming mode selection switch 82 to the SYS controller 83, this SYS controller 83 requests the controller 74 to issue the control sequence in the double-surface print mode. Then, the ROS-OFF signal set to the second surface print different from the signal during the first surface image forming operation is sent from the controller 74, especially, to the ROS driver 70 of the image exposing apparatus 12.

Figure 7B:
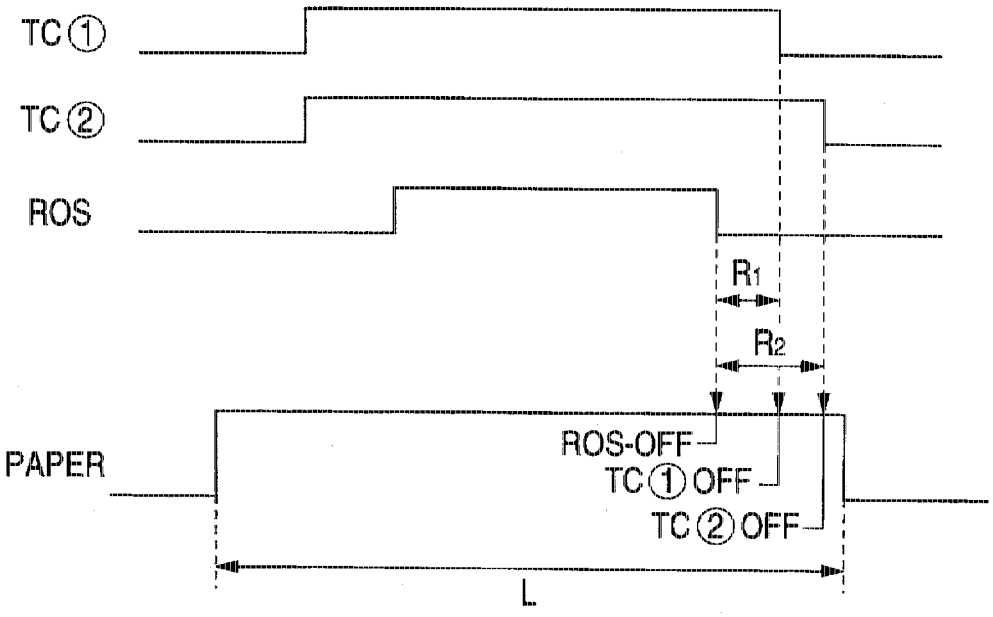
Figure 8A:
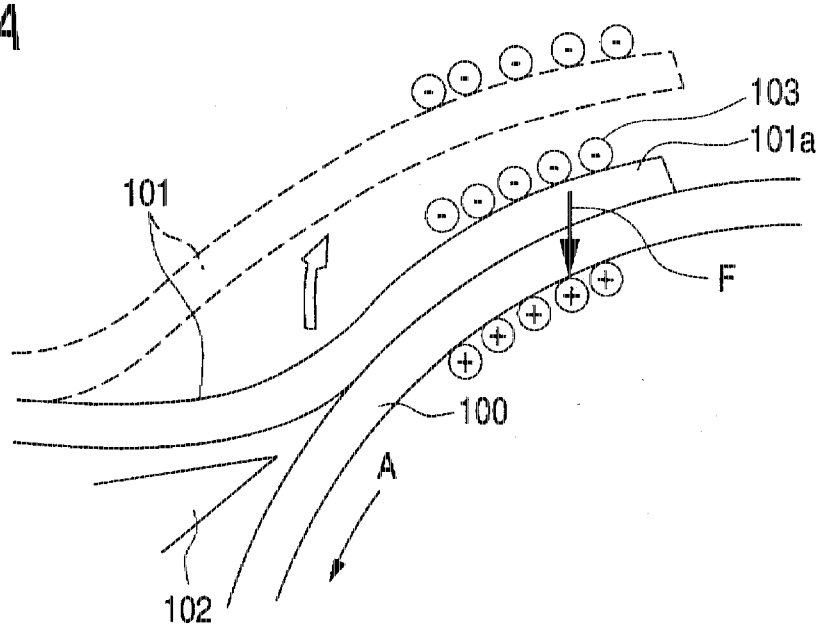
FIGS. 8A and 8B are conceptional diagrams for explaining the toner scattering phenomenon occurred at the rear end portion of the paper when the recording paper is exfoliated from the paper carrying/transporting member in the prior art.
Figure 8B:
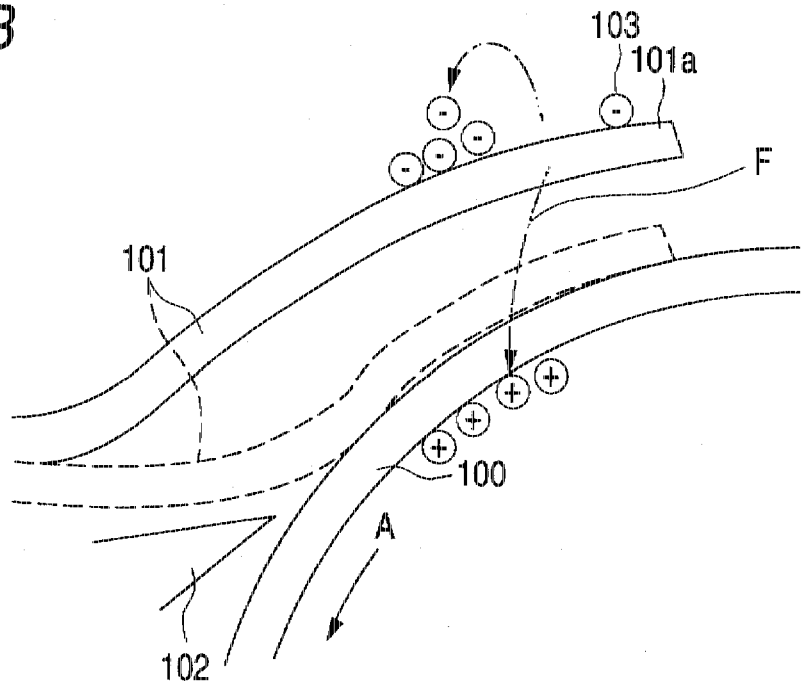

It should be noted that the control method for varying the length of the adsorb-charging region when the image is formed on the second surface is not limited to the above-described method for controlling only the operation-OFF timing of the image exposing apparatus 12. As shown in FIG. 7B, in addition thereto, a method for controlling only the operation-OFF timing of the adsorb-transfer corotron 21 may be employed in such a manner that the operation-OFF timing (TC2-OFF) of the adsorb-transfer corotron 21 during the second surface image forming operation is made longer (delayed) than the operation-OFF timing (TC1-OFF) thereof during the first surface image forming operation. Alternatively, both the operation-OFF timing of the image exposing apparatus 12 and the operation-OFF timing of the adsorb-transfer corotron 21 may be controlled.

As previously described, in accordance with the present invention, even in the image forming apparatus such that both the adsorb-charging operation and the transfer-charging operation are performed by a single charging means, since the adsorb-charging region having a predetermined length is formed backwardly from the rear end of the image region of the recording paper, the adsorbing force of this rear end of the paper can be sufficiently secured with respect to the paper carrying/transporting member. As a result, it is possible to avoid the image defect readily occurred when this recording paper is exfoliated from the paper carrying/transporting member after the transfer step is accomplished, which is caused by the toner scattering phenomenon at the rear end of the recording paper.

Also, the operation-OFF timing for the electrostatic image forming means and the charging means in order to form the above-described adsorb-charging region is controlled by employing the signal periodically produced in conjunction with the rotations of the recording paper carrying/transporting member as the reference signal. As a consequence, the control precision is not lowered which is caused by the sensor recording error and the OFF-signal error of the register roller, which occur in the prior art. Also, it is surely possible to prevent the above-explained image defect by the toner scattering phenomenon.

Moreover, even when the non-fixed size recording paper whose length along the paper transportation direction is unknown is employed, and the images are formed on both surfaces of the recording paper, the above-described adsorb-charging region is properly formed, so that the image defect caused by the toner scattering phenomenon can be firmly avoided.

These above-mentioned embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus, comprising:

latent image forming means for forming an electrostatic latent image;

an image carrier on which a toner image is formed by developing the latent image formed by said latent image forming means;

a recording paper carrying/transporting member arranged adjacent to a transfer position of this image carrier, for transporting a recording paper to which the toner image on the image carrier is transferred, while adsorbing said recording paper;

one adsorb-transferring charging means for performing an adsorb-charging operation for causing the recording paper to be adsorbed on said recording paper carrying/transporting member and a transfer-charging operation for transferring the toner image on the recording paper; and control means for controlling operation-OFF timing of said adsorb-transferring charging means so that the operation-OFF timing is delayed from operation-OFF timing of said latent image forming means to form an adsorb-charging region having a predetermined length along the paper transporting direction from a rear end of an image region on the recording paper adsorbed on said recording paper carrying/transporting member backwardly.

2. An image forming apparatus as claimed in claim 1, wherein the predetermined length of the adsorb-charging region formed by said control means is equal to or longer than 1.5 mm.

3. An image forming apparatus as claimed in claim 1, wherein Said control means controls the operation-OFF timing of said latent image forming means and said adsorb-transferring charging means with a signal periodically produced in conjunction with a rotation of said recording paper carrying/transporting member as a reference signal.

4. An image forming apparatus as claimed in claim 1, wherein said control means rotates the recording paper carrying/transporting member by 1 cycle only so as to adsorb such a recording paper having a non-fixed size when said recording paper having the non-fixed size whose length along the paper transporting direction is unknown is used, and controls the operation-OFF timing of said latent image forming means and said adsorb-transferring charging means, while the length of the recording paper having the non-fixed size along the paper transporting direction is sensed by paper size sensing means installed in a recording paper transporting path before an absorption.

5. An image forming apparatus as claimed in claim 1 wherein when images are formed on both first and second surfaces of the recording paper, said control means performs such a control that a length of an adsorb-charging region along the paper transporting direction when the image is formed on the second surface is made longer than a length of an adsorb-charging region along the paper transporting direction when the image is formed on the first surface.

* * * * *